US008763375B2

(12) United States Patent
Wieland et al.

(10) Patent No.: US 8,763,375 B2
(45) Date of Patent: Jul. 1, 2014

(54) EXHAUST GAS CLEANING DEVICE, EXHAUST SYSTEM, REMOVAL METHOD

(75) Inventors: Arthur Wieland, Baltmannsweiler (DE); Michael Krause, Esslingen (DE); Felix Neumann, Esslingen (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 185 days.

(21) Appl. No.: 13/213,589

(22) Filed: Aug. 19, 2011

(65) Prior Publication Data

US 2012/0042638 A1 Feb. 23, 2012

(30) Foreign Application Priority Data

Aug. 19, 2010 (DE) ..... 10 2010 034 743

(51) Int. Cl.

| | |
|---|---|
| ***F01N 3/00*** | (2006.01) |
| ***F01N 3/10*** | (2006.01) |
| ***F01N 3/02*** | (2006.01) |
| ***B01D 50/00*** | (2006.01) |
| ***B01D 59/50*** | (2006.01) |

(52) U.S. Cl.
USPC ..... 60/297; 60/299; 60/311; 55/483

(58) Field of Classification Search
USPC ..... 60/297, 299, 311; 29/426.1; 55/483, 55/496, 502
See application file for complete search history.

(56) References Cited

U.S. PATENT DOCUMENTS

| | | | | |
|---|---|---|---|---|
| 3,854,888 | A * | 12/1974 | Frietzsche et al. | 422/171 |
| 3,898,802 | A | 8/1975 | Tadokoro et al. | |
| 3,989,471 | A | 11/1976 | Nowak | |
| 4,004,887 | A * | 1/1977 | Stormont | 422/179 |
| 4,043,761 | A | 8/1977 | Gaysert et al. | |
| 4,101,280 | A | 7/1978 | Frietzsche et al. | |
| 4,108,276 | A | 8/1978 | Hall et al. | |
| 4,115,071 | A | 9/1978 | Masuda et al. | |
| 4,145,394 | A | 3/1979 | Abthoff et al. | |
| 4,155,980 | A | 5/1979 | Santiago et al. | |
| 4,188,783 | A | 2/1980 | Sayo et al. | |
| 4,344,922 | A | 8/1982 | Santiago et al. | |
| 4,353,873 | A | 10/1982 | Noritake et al. | |
| 4,601,168 | A | 7/1986 | Harris | |
| 4,730,454 | A | 3/1988 | Pischinger et al. | |

(Continued)

FOREIGN PATENT DOCUMENTS

| | | |
|---|---|---|
| DE | 2 222 663 A1 | 12/1973 |
| DE | 2 307 215 A1 | 8/1974 |

(Continued)

*Primary Examiner* — Audrey K Bradley
(74) *Attorney, Agent, or Firm* — Reinhart Boerner Van Deuren P.C.

(57) ABSTRACT

The present invention relates to an exhaust gas cleaning device (2) of an exhaust system (1) of a combustion engine, more preferably of a motor vehicle, with a catalytic converter unit (3) having a catalytic converter support pipe (7) and at least one oxidation catalytic converter element (8) mounted in the catalytic converter support pipe (7), and with a particle filter unit (4) having a particle filter support pipe (11) and at least one particle filter element (12) mounted in the particle filter support pipe (11).

A simple handling with simple construction can be achieved with a receiving pipe (5) in which one of the support pipes (7, 11) is axially inserted, and with a clamp connection (6) which sets the receiving pipe (5), the catalytic converter support pipe (7) and the particle filter support pipe (11) against one another.

2 Claims, 2 Drawing Sheets

(56) References Cited

U.S. PATENT DOCUMENTS

| | | | | |
|---|---|---|---|---|
| 5,009,065 | A | 4/1991 | Howe et al. | |
| 5,016,438 | A | 5/1991 | Harris | |
| 5,082,479 | A | 1/1992 | Miller | |
| 5,186,906 | A | 2/1993 | Kawakami et al. | |
| 5,198,625 | A | 3/1993 | Borla | |
| 5,212,948 | A | 5/1993 | Gillingham et al. | |
| 5,358,287 | A | 10/1994 | Winzen | |
| 5,396,764 | A | 3/1995 | Rao et al. | |
| 5,426,269 | A | 6/1995 | Wagner et al. | |
| 5,555,621 | A | 9/1996 | Tanabe et al. | |
| 5,606,857 | A | 3/1997 | Harada | |
| 5,808,245 | A | 9/1998 | Wiese et al. | |
| 5,916,530 | A | 6/1999 | Maus et al. | |
| 6,394,225 | B1 | 5/2002 | Yasuda | |
| 6,397,586 | B1 | 6/2002 | Sakurai et al. | |
| 6,543,575 | B1 | 4/2003 | Marcellus | |
| 6,635,227 | B1 | 10/2003 | Shibata et al. | |
| 6,729,127 | B2 | 5/2004 | Woerner et al. | |
| 6,837,336 | B2 | 1/2005 | Gault et al. | |
| 6,868,670 | B1 | 3/2005 | Schellin | |
| 6,935,461 | B2 | 8/2005 | Marocco | |
| 6,941,751 | B2 | 9/2005 | Yamamoto et al. | |
| 7,051,523 | B2 | 5/2006 | Kerchner | |
| 7,093,428 | B2 | 8/2006 | LaBarge et al. | |
| 7,127,884 | B2 | 10/2006 | Wörner et al. | |
| 7,334,402 | B2 | 2/2008 | Hiraga | |
| 7,662,204 | B2 | 2/2010 | Forster et al. | |
| 7,694,778 | B2 | 4/2010 | Toyoshima et al. | |
| 2003/0108457 | A1 | 6/2003 | Gault et al. | |
| 2003/0159436 | A1* | 8/2003 | Foster et al. | 60/297 |
| 2004/0109795 | A1* | 6/2004 | Marc | 422/177 |
| 2004/0202591 | A1 | 10/2004 | Jacob et al. | |
| 2006/0053779 | A1 | 3/2006 | Belisle et al. | |
| 2006/0157296 | A1 | 7/2006 | Belisle | |
| 2006/0266022 | A1 | 11/2006 | Woerner et al. | |
| 2007/0011874 | A1 | 1/2007 | Myers | |
| 2007/0137184 | A1 | 6/2007 | Patchett et al. | |
| 2007/0144126 | A1 | 6/2007 | Ohya et al. | |
| 2009/0158721 | A1 | 6/2009 | Wieland et al. | |
| 2009/0208393 | A1 | 8/2009 | Wenzel et al. | |
| 2009/0241512 | A1 | 10/2009 | Wirth | |
| 2009/0266065 | A1 | 10/2009 | Barrieu et al. | |
| 2009/0272106 | A1 | 11/2009 | Werni et al. | |
| 2010/0061898 | A1 | 3/2010 | Lehnen et al. | |
| 2011/0203692 | A1 | 8/2011 | Werni et al. | |
| 2011/0252776 | A1 | 10/2011 | Schwarz et al. | |
| 2011/0256032 | A1 | 10/2011 | Schwarz et al. | |

FOREIGN PATENT DOCUMENTS

| | | | |
|---|---|---|---|
| DE | 23 64 425 | A1 | 7/1975 |
| DE | 24 07 263 | A1 | 9/1975 |
| DE | 34 32 283 | A1 | 3/1986 |
| DE | 92 05 294 | U1 | 6/1992 |
| DE | 43 18 343 | A1 | 12/1994 |
| DE | 44 46 986 | A1 | 7/1995 |
| DE | 197 11 789 | A1 | 10/1998 |
| DE | 199 29 423 | A1 | 1/2000 |
| DE | 199 59 955 | A1 | 6/2000 |
| DE | 199 18 301 | C1 | 10/2000 |
| DE | 100 21 494 | A1 | 8/2001 |
| DE | 100 20 492 | A1 | 10/2001 |
| DE | 101 05 841 | A1 | 8/2002 |
| DE | 103 00 780 | A1 | 7/2004 |
| DE | 10 2004 021 474 | B3 | 3/2005 |
| DE | 103 34 307 | A1 | 3/2005 |
| DE | 103 56 000 | A1 | 7/2005 |
| DE | 103 60 726 | A1 | 7/2005 |
| DE | 10 2004 051512 | A1 | 5/2006 |
| DE | 10 2005 017947 | A1 | 10/2006 |
| DE | 10 2005 025045 | A1 | 12/2006 |
| DE | 10 2005 044494 | B3 | 3/2007 |
| DE | 10 2007 010486 | A1 | 9/2008 |
| DE | 10 2007 062 663 | A1 | 6/2009 |
| DE | 10 2008 022081 | A1 | 11/2009 |
| EP | 0 112 634 | A1 | 7/1984 |
| EP | 0 176 722 | A1 | 4/1986 |
| EP | 0 393 257 | A1 | 10/1990 |
| EP | 0 420 521 | A1 | 4/1991 |
| EP | 0 471 175 | A1 | 2/1992 |
| EP | 0 537 603 | A1 | 4/1993 |
| EP | 0 580 963 | A1 | 2/1994 |
| EP | 0 724 070 | A1 | 7/1996 |
| EP | 0 953 741 | A1 | 11/1999 |
| EP | 1 149 992 | A1 | 10/2001 |
| EP | 1 236 872 | A1 | 9/2002 |
| EP | 1 329 608 | A2 | 7/2003 |
| EP | 1 462 625 | A1 | 9/2004 |
| EP | 1 536 113 | A2 | 6/2005 |
| EP | 1 653 059 | A1 | 5/2006 |
| EP | 1 715 154 | A2 | 10/2006 |
| FR | 2 617 536 | A1 | 1/1989 |
| FR | 2 821 117 | A1 | 8/2002 |
| FR | 2 877 038 | A1 | 4/2006 |
| JP | 2002-070524 | A | 3/2002 |
| WO | WO 2006/117468 | A1 | 11/2006 |

* cited by examiner

EXHAUST GAS CLEANING DEVICE, EXHAUST SYSTEM, REMOVAL METHOD

CROSS-REFERENCE TO RELATED PATENT APPLICATIONS

This patent application claims the benefit of German Patent Application No. 10 2010 034743.4, filed Aug. 19, 2010, the entire teachings and disclosure of which are incorporated herein by reference thereto.

FIELD OF THE INVENTION

The present invention relates to an exhaust gas cleaning device of an exhaust system of a combustion engine, particularly of a motor vehicle. The invention additionally relates to an exhaust system of a combustion engine equipped with such an exhaust gas cleaning device, particularly of a motor vehicle. Finally the invention relates to a method for the removal of a catalytic converter unit with such an exhaust gas cleaning device.

BACKGROUND OF THE INVENTION

For emission reduction it is known to arrange in an exhaust system a particle filter, particularly a soot filter, as well as an oxidation catalytic converter, particularly a diesel oxidation catalytic converter one after the other. To achieve a compact design it is possible in principle here to accommodate the particle filter and the oxidation catalytic converter in a single exhaust gas cleaning device in that for example an oxidation catalytic converter element and a particle filter element are arranged in the exhaust gas flow direction one after the other. Modern exhaust gas cleaning devices of this kind can be practically equipped so that the particle filter element is replaceable. The changing or replacing of a particle filter element can be required during the lifetime of the exhaust gas cleaning device or of the exhaust system, since during the operation of the exhaust system non-regenerable deposits can accumulate in the particle filter, which reduces the flow resistance of the particle filter and the storage capacity for regenerable deposits.

In principle, it is also feared that the oxidation catalytic converters gradually lose their effectiveness during the operation of the exhaust system. For example, non-regenerable contaminations can also occur with catalytic converters, which contaminations can also be called catalytic converter poisoning.

There is therefore the need to configure an exhaust gas cleaning device so that both the particle filter as well as the oxidation catalytic converter can be replaced. The effort for realising such an exhaust gas cleaning device however is comparatively great since a plurality of releasable connecting points have to be provided in order to be able to carry out the respective change.

The present invention deals with the problem of stating an improved embodiment for an exhaust gas cleaning device or for an exhaust system equipped with such an exhaust gas cleaning device, which is particularly characterized in that it can be realised comparatively cost-effectively.

According to the invention, this problem is solved through the subjects of the independent claims. Advantageous embodiments are the subject of the dependent claims.

SUMMARY OF THE INVENTION

The invention is based on the general idea of equipping the exhaust gas cleaning device with a catalytic converter unit and with a particle filter unit, wherein the catalytic converter unit comprises a catalytic converter support pipe and at least one oxidation catalytic converter element mounted in the catalytic converter support pipe, while the particle filter unit comprises a particle filter support pipe and at least one particle filter element mounted in the particle filter support pipe. In order to now make possible the changing of the catalytic converter unit and of the particle filter unit the exhaust gas cleaning device additionally comprises a receiving pipe in which one of the support pipes, preferentially the catalytic converter support pipe, is exclusively inserted axially. Because of this, a construction can be realised, wherein the axial face ends of the two support pipes facing each other and an axial face end of the receiving pipe are arranged in a common axial portion in such a manner that with the help of a single clamp connection the receiving pipe, the catalytic converter support pipe and the particle filter support pipe can be fixed to one another. By releasing this one clamp connection the one support pipe, which is not inserted in the receiving pipe, can be removed from the receiving pipe. Following this, the other support pipe which is inserted in the receiving pipe can be pulled out of the receiving pipe. Thus, both support pipes with the respective element arranged therein can be easily replaced or changed.

Preferably, the catalytic converter support pipe is inserted in the receiving pipe so that with released clamp connection and with removed particle filter support pipe the catalytic converter support pipe with the respective catalytic converter element mounted therein, i.e. the entire catalytic converter unit, can be removed from the receiving pipe. Practically, the catalytic converter unit is arranged within the exhaust gas cleaning device upstream of the particle filter unit, regardless of whether the particle filter unit or the catalytic converter unit is arranged in the receiving pipe.

According to an advantageous embodiment the receiving pipe at the face end in the clamp connection can comprise a circumferential receiving pipe collar standing away to the outside. The catalytic converter support pipe at the face end in the clamped connection can comprise a circumferential catalytic converter pipe collar standing away to the outside. Furthermore, the particle filter support pipe at the face end in the clamp connection can also comprise a circumferential particle filter support pipe collar standing away to the outside. The three pipe collars in the clamp connection axially abut one another while forming a three-layer structure or a sandwich structure. Because of this, the realisation of an adequately gas-tight clamp connection is facilitated.

With a preferred embodiment, wherein the catalytic converter unit is inserted in the receiving pipe, the catalytic converter support pipe collar axially supports itself on the receiving pipe collar, while the particle filter support pipe collar supports itself axially on the catalytic converter support pipe collar on a side facing away from the receiving pipe.

Particularly advantageous is an embodiment, wherein between collars axially supported on one another a circumferential seal each is formed, which more preferably can be designed as beaded seal and preferentially as metal beaded seal. Because of this, the gas-tightness of the clamp connection can be improved. Through the realisation of the respective seal as beaded seal, particularly as metal beaded seal, the respective seal can be integrally moulded on the respective collar, which substantially simplifies the assembly and disassembly.

According to an advantageous embodiment the clamp connection can comprise a receiving pipe clamping ring which on a side facing away from the catalytic converter support pipe collar axially abuts the receiving pipe collar. In addition, the clamp connection can comprise a support pipe clamping ring, which on a side facing away from the receiving pipe collar axially abuts the respective support pipe collar. Furthermore, the clamp connection practically comprises a clamp which axially clamps the clamping rings towards each other. Since axially between the two clamping rings, the three-layer collar structure is arranged, the axial clamping of the clamping rings simultaneously results in an axial clamping of the collars axially abutting one another.

According to a particularly advantageous embodiment the support pipe clamping ring can have a smaller open inner cross section than the receiving pipe clamping ring. Because of this, different outer geometries, particularly different outer cross sections of support pipe and receiving pipe can be offset. Here, the clamping rings can practically have same outer cross sections, as a result of which a certain symmetry is obtained within the clamp connection, which simplifies the realisation of an effective clamp connection.

With an alternative embodiment, the clamping rings can have same open inner cross sections, wherein the clamp connection is then additionally equipped with a height compensation ring, which is radially arranged between the respective support pipe and the support pipe clamping ring. With this embodiment, same design clamping rings can be used, while the geometry offsetting or the offsetting of the different outer cross sections of receiving pipe and support pipe is realised with the help of the height compensation ring. The term "height" in this context refers to the radial direction which extends transversely to the longitudinal direction of the pipes. Here, too, the clamping rings can more preferably comprise same outer cross sections. Preferentially, the clamping rings are identical parts.

According to an advantageous embodiment the height compensation ring and the receiving pipe mentioned above can have same outer cross sections at least in the region of the clamp connection, which simplifies the use of same clamping rings.

According to another advantageous embodiment, the exhaust gas cleaning device can comprise a housing with a housing wall, wherein the receiving pipe penetrates the housing wall and is fastened to the housing. Thus, the receiving pipe with respect to the housing is a stationary component. The clamp connection is now practically arranged outside the housing. To this end, the receiving pipe stands out of the housing. Because of this, an improved accessibility to the clamp connection is obtained. The receiving pipe is practically fastened to the housing wall. The housing wall can have a housing bottom which is laterally bounded by a housing jacket. Preferably, the receiving pipe now penetrates the housing bottom and can be more preferably fastened to the housing bottom.

Practically, the pipes, that is the support pipes and the receiving pipes, are straight. The support pipes can have same inner cross sections. On the receiving pipe, a perforated sleeve can be arranged on a side facing away from the clamp connection, which sleeve is then more preferably located within the housing. The housing itself can be designed as silencer and/or comprise an SCR-system, more preferably with urea injection.

The removal of the catalytic converter unit with the exhaust gas cleaning device introduced here can be realised particularly easily. Initially, the clamp connection is opened. Following this, a unit, for example the particle filter unit, is removed radially. Following this, the other unit, for example the catalytic converter unit, is axially removed from the receiving pipe.

Further important features and advantages of the invention are obtained from the subclaims, from the drawings and from the corresponding Figure description by means of the drawings.

It is to be understood that the features mentioned above and still to be explained in the following cannot only be used in the respective combination state but also in other combinations or by themselves, without leaving the scope of the present invention.

BRIEF DESCRIPTION OF THE DRAWINGS

Preferred exemplary embodiments of the invention are shown in the drawings and will be explained in more detail in the following description, wherein same reference characters refer to same or similar or functionally same components.

It shows, in each case schematically

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
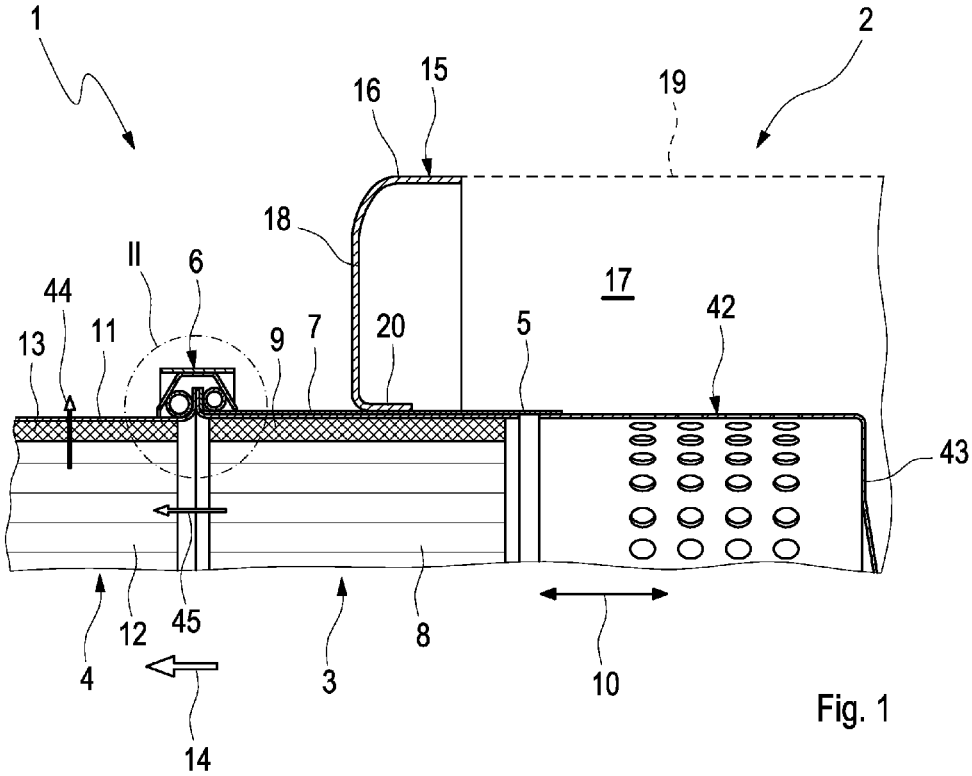
FIG. 1 is a greatly simplified longitudinal section through a part of an exhaust gas cleaning device.

According to FIG. 1, an exhaust system 1 of a combustion engine, which can be more preferably arranged in a motor vehicle, comprises an exhaust gas cleaning device 2. The exhaust gas cleaning device 2 comprises a catalytic converter unit 3 as well as a particle filter unit 4. Furthermore, the exhaust gas cleaning device 2 comprises a receiving pipe 5 and a clamp connection 6.

The catalytic converter unit 3 consists of a catalytic converter support pipe 7, of at least one oxidation catalytic converter element 8 and of at least one mounting 9, with the help of which the respective oxidation catalytic converter element 8 is mounted in the catalytic converters or pipe 7. The catalytic converter support pipe 7 extends linearly with respect to an axial direction 10. The particle filter unit 4 consists of a particle filter support pipe 11, of at least one particle filter element 12 and of at least one mounting 13, with the help of which the respective particle filter element 12 is mounted in the particle filter support pipe 11. The particle filter support pipe 11, too, extends linearly parallel to the axial direction 10. More preferably, the two support pipes 7, 11 are aligned coaxially relative to each other, so that they are axially aligned with each other. A preferred flow direction 14, in which the exhaust gas flows in operation of the exhaust gas cleaning device 2 is additionally shown in FIG. 1. Accordingly, the particle filter unit 4 is preferably arranged downstream of the catalytic converter unit 3. A reverse flow direction 14 is also possible in principle.

The receiving pipe 5 is likewise arranged parallel to the axial direction 10 and designed linearly. With the preferred embodiment introduced here the catalytic converter unit 3 is axially inserted into the receiving pipe 5. With another embodiment, the particle filter unit 4 can be axially inserted in the receiving pipe 5 instead. In the following, the preferred embodiment reproduced here will be explained in more detail, in which embodiment the catalytic converter unit 3 is inserted in the receiving pipe 5. It is clear that the following explanations can be similarly transferred easily to the other embodiment as well, with which embodiment the particle filter unit 4 is inserted in the receiving pipe 5.

The clamp connection 6 realises a releasable connection between the components of the exhaust gas cleaning device 2, namely between the receiving pipe 5, the catalytic converter unit 3 and the particle filter unit 4. The clamp connection 6 sets the receiving pipe 5, the catalytic converter support pipe 7 and the particle filter support pipe 11 against one another.

With the embodiment shown in FIG. 1 the exhaust gas cleaning device 2 additionally has an only partially shown housing 15 comprising a housing wall 16, which encloses a housing interior 17. The housing wall 16 comprises a housing bottom 18 shown here, which delimits the housing interior 17 axially or at the face end. Furthermore, the housing wall 16 comprises a housing jacket 19 indicated with an interrupted line which laterally or in circumferential direction encloses the housing interior and which in a suitable manner is connected to the housing bottom in a fixed fashion.

The receiving pipe 5 is attached to the housing 15 so that it penetrates the housing wall 16 in the housing bottom 18 and stands away from the housing 15 to the outside. Thus, the clamp connection 6 can be arranged outside the housing 15. The receiving pipe 5 is additionally fastened to the housing 15. In the example, a bottom passage 20 is moulded on the housing bottom 18 in which the receiving pipe 7 is axially introduced and on which the receiving pipe 7 is fastened, more preferably by means of a brazed connection or by means of a welded connection.

In the housing interior 17 a perforated sleeve 42 is additionally arranged, which is arranged on an end of the support pipe 5 facing away from the clamp connection 6. The sleeve 42 can have a bottom 43 at an axial end facing away from the support pipe 5, which can more preferably be likewise perforated.

Figure 2:
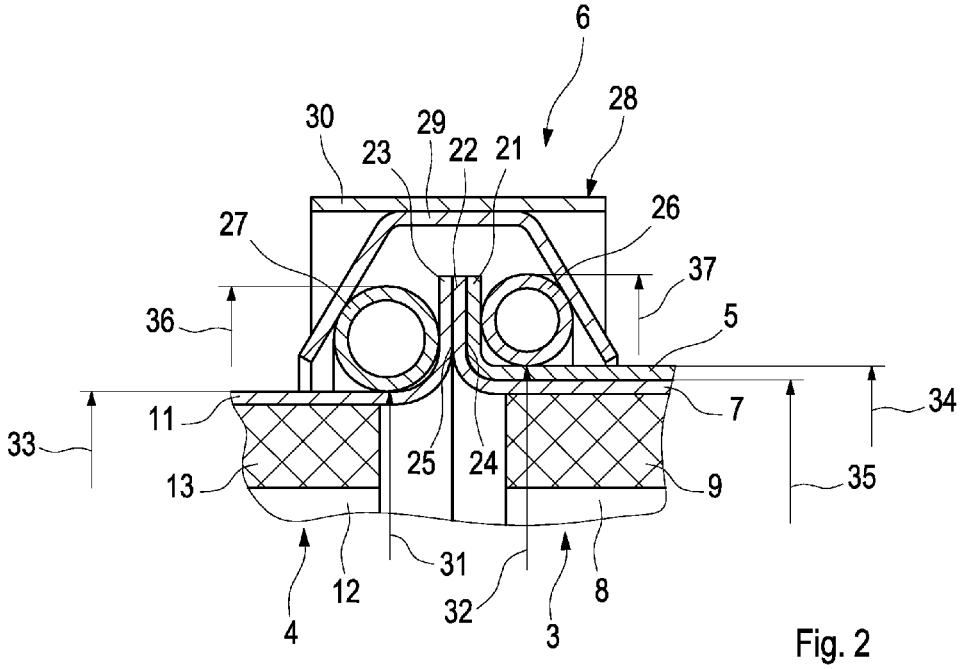
FIG. 2 is an enlarged detail II from FIG. 1, namely a longitudinal section in the region of a clamp connection.
Figure 3:
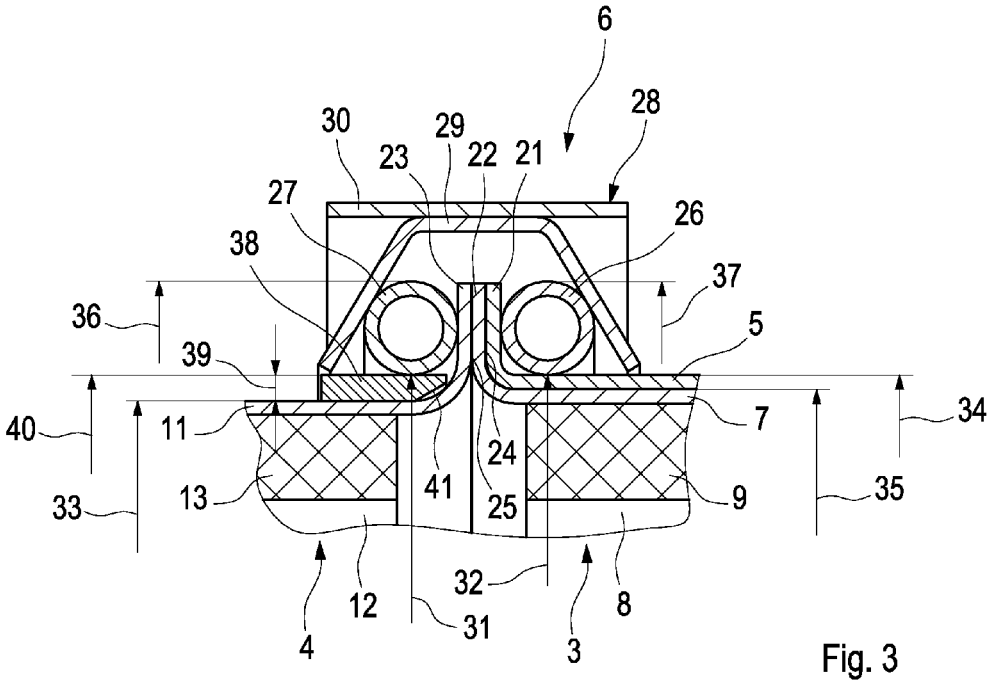
FIG. 3 is a view as in FIG. 2, however with another embodiment.

According to FIGS. 2 and 3 the receiving pipe 5 comprises a receiving pipe collar 21 which is arranged on the receiving pipe 5 at the face end, is located in the clamp connection and thereby radially stands away from the receiving pipe 5 to the outside and runs circumferentially in the circumferential direction. The catalytic converter support pipe 7 at the face end within the clamp connection 6 also comprises a catalytic converter support pipe collar 22 circumferentially running in circumferential direction and radially standing away to the outside. The particle filter support pipe 11 at the face end within the clamp connection 6 also comprises a circumferential particle filter support pipe collar 23 standing away to the outside. With the configuration shown here, wherein the catalytic converter unit 3 is axially inserted in the receiving pipe 5, the catalytic converter support pipe collar 22 is axially supported on the receiving pipe collar 21. Furthermore, the particle filter support pipe collar 23 is axially supported on the catalytic converter support pipe collar 22 on a side facing away from the receiving pipe 5. Thus, the three collars 21, 22, 23 abutting one another form a three-layer structure, namely a sandwich structure, wherein the catalytic converter support pipe collar 22 is arranged between the receiving pipe collar 21 and the particle filter support pipe collar 23.

Between the receiving pipe collar 21 and the catalytic converter support pipe collar 22 a circumferential seal 24 can be arranged. In addition or alternatively, a circumferential seal 25 can likewise be arranged between the catalytic converter support pipe collar 22 and the particle filter support pipe collar 23. More preferably, the respective seal 24, 25 can be a beaded seal, preferentially a metal beaded seal. Such a beaded seal 24, 25 can be more preferably moulded out of the respective collar 21, 22, 23.

The clamp connection 6 comprises a receiving pipe clamping ring 26, a support pipe clamping ring 27 and a clamp 28. The receiving pipe clamping ring 26 is axially arranged on the receiving pipe collar 21 on a side facing away from the catalytic converter support pipe collar 22. The support pipe clamping ring 27 with the embodiment shown here is axially arranged on the particle filter support pipe collar 23 on a side facing away from the catalytic converter support pipe collar 22. The clamp 28 is configured so that in the assembled state it axially clamps the two clamping rings 26, 27 towards each other. The two clamping rings 26, 27 between them axially clamp the three-layered sandwich structure of the collars 21, 22, 23 abutting one another, which results in the desired strength and tightness within the clamp connection 6.

The clamp 28 with the example shown here comprises at least one profile body 29, which in the longitudinal section shown has a substantially V-shaped profile and which with a clamping force radially acting from the outside to the inside axially drives the clamping rings 26, 27 towards each other. Here, the clamp 28 furthermore comprises a clamping band 30 into which a tensile force can be introduced in the circumferential direction by means of a suitable clamping device of the clamp 29 which is not shown here. This clamping band 30 transmits this tensile stress orientated in the circumferential direction onto the respective profile body 29 in the form of a force orientated radially to the inside.

With the embodiment shown in FIG. 2 the support pipe clamping ring 27 has an open inner cross section 31, which is smaller than an open inner cross section 32 of the receiving pipe clamping ring 26. Because of this it is possible to offset different outer cross sections 33, 34 of the particle filter support pipe 11 and receiving pipe 5. For example, the outer cross section 33 of the particle filter support pipe 11 is smaller than the outer cross section 34 of the receiving pipe 5. More preferably, an outer cross section 35 of the catalytic converter support pipe 7 can be approximately same in size as the outer cross section 33 of the particle filter support pipe 11. Because of this it is more preferably possible to dimension the throughflow-capable cross sections of the particle filter unit 4 and the catalytic converter unit 3 substantially equal in size.

Independently of their inner cross sections 31, 32 the clamping rings 26, 27 can have outer cross sections 36 and 37 which are same in size.

With the embodiments shown in FIG. 3 the clamp connection 6 comprises a height compensation ring 38. This height compensation ring 38 is arranged radially between the particle filter support pipe 11 and the support pipe clamping ring 27. A thickness 39 of the height compensation ring 38 measured in the radial direction in this case determines the "height" that can be offset with the help of the height compensation ring 38. In the example, this thickness 39 is selected so large that it can offset the difference between the outer cross section 34 of the receiving pipe 5 and the outer cross section 33 of the particle filter support pipe 11. It is more preferably possible then to dimension the two clamping rings 26, 27 same in size with respect to their inner cross sections 31, 32. In addition, the two clamping rings 26, 27 with respect to their outer cross sections 36, 37 can be dimensioned equal in size so that it is ultimately possible to design the two clamping rings 26, 27 as identical parts.

In the example of FIG. 3 an outer cross section 40 of the height compensation ring 38 within the clamp connection 6 is equal in size to the outer cross section 34 of the receiving pipe 5. The height compensation ring 38 with respect to its axial length is dimensioned so large that it can be completely arranged within the clamp connection 6. More preferably, the height compensation ring 38 to this end can have an inner bevel 41 at least on an axial face end facing the particle filter support pipe collar 23, in order to be able to arrange the height compensation ring 38 as near to the particle filter support pipe collar 23 as possible.

With respect to FIG. 1, a preferred method for the removal of the catalytic converter unit 3 is now explained in more detail.

In a first step the clamp connection 6 is opened. In a second step the particle filter unit 4 is radially removed corresponding to an arrow 44, that is transversely to the axial direction 10. In a third step the catalytic converter unit 3 is axially removed from the receiving pipe 5 corresponding to an arrow 45, that is parallel to the axial direction 10.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An exhaust gas cleaning device of an exhaust system of a combustion engine, comprising:

a catalytic converter unit having a catalytic converter support pipe defining an interior peripheral surface and at least one oxidation catalytic converter element mounted in the catalytic converter support pipe, a particle filter unit having a particle filter support pipe defining an interior peripheral surface, and at least one particle filter element mounted in the particle filter support pipe, a receiving pipe in which the catalytic converter support pipe is axially inserted, a clamp connection which sets the receiving pipe, the catalytic converter support pipe and the particle filter support pipe against one another;

wherein the interior peripheral surface of each of the catalytic converter support pipe and the particle filter support pipe are at least partially in axial contact with one another;

wherein the receiving pipe at a face end in the clamp connection comprises a circumferential receiving pipe collar standing away to the outside, the catalytic converter support pipe at a face end in the clamp connection comprises a circumferential catalytic converter support pipe collar standing away to the outside, and the particle filter support pipe at a face end in the clamp connection comprises a circumferential particle filter support pipe collar standing away to the outside;

wherein the clamp connection comprises two clamping rings and a clamp axially clamping the two clamping rings towards each other;

wherein one clamping ring is designed as a receiving pipe clamping ring, which axially abuts the receiving pipe collar on a side facing away from the catalytic converter support pipe collar, while the other clamping ring is designed as a support pipe clamping ring which axially abuts the particle filter support pipe collar on a side facing away from the catalytic converter support pipe collar.

2. The exhaust gas cleaning device according to claim 1, wherein the support pipe clamping ring has a smaller open inner cross section than the receiving pipe clamping ring.

* * * * *